US005284079A

United States Patent [19]

Wang

[11] Patent Number: 5,284,079

[45] Date of Patent: Feb. 8, 1994

[54] TAMBOURINE

[76] Inventor: Jeng-Shyong Wang, No. 9-3, Hai-Wei Tzu Lane, Chung-Yang Rd., Chung-Ho Tsun, Lung-Ching Hsiang, Taichung Hsien, Taiwan

[21] Appl. No.: 8,306

[22] Filed: Jan. 25, 1993

[51] Int. Cl.[5] ..... G10D 13/02

[52] U.S. Cl. ..... 84/418; D17/22

[58] Field of Search ..... 84/418, 402, 411 R; D17/22

[56] References Cited

U.S. PATENT DOCUMENTS

| | | | |
|---|---|---|---|
| 3,608,417 | 9/1971 | Koishikawa | 84/418 |
| 3,635,120 | 1/1972 | Koishikawa | 84/418 |
| 4,858,510 | 8/1989 | Shimoda et al. | 84/418 |

*Primary Examiner*—Michael L. Gellner
*Assistant Examiner*—Cassandra C. Spyrou
*Attorney, Agent, or Firm*—Nixon & Vanderhye

[57] ABSTRACT

A tambourine includes an annular frame which has a plurality of equidistant rectangular positioning holes formed therethrough, a plurality of flexible positioning plates respectively fitted in the positioning holes, and a plurality of positioning bars respectively extending through a plurality of jingle units. Each of the positioning holes is defined by two shorter hole walls and two longer hole walls which have two stop ribs projecting toward each other therefrom. Each of the positioning plates has two positioning ribs abutting against the corresponding longer hole wall and has two locking ribs abutting against the annular frame so as to retain the positioning plate on the annular frame. Each of the positioning plates has a jingle slot formed therethrough. A pair of in-line receiving grooves are formed in the inward surface of the positioning plate on two sides of the jingle slot so as to receive one of the positioning bars within the receiving grooves in such a manner that the jingle unit extends through the jingle slot. Each end of the positioning bar is positioned between the corresponding stop rib of the annular frame and the corresponding positioning rib of the positioning plate in such a manner that the jingle unit is retained on the annular frame.

4 Claims, 5 Drawing Sheets

TAMBOURINE

BACKGROUND OF THE INVENTION

1. Field Of The Invention

This invention relates to a tambourine, more particularly to a tambourine in which the number of jingle units that are mounted thereon can be varied.

2. Description of The Related Art

Referring to FIG. 1, a conventional tambourine includes: a main frame (1); a predetermined number of jingle slots (2) formed in the main frame (1); a plurality of positioning hole units (3) formed through the main frame (1); a predetermined number of jingle units (4) respectively extending through the jingle slots (2), each of the jingle units (4) having an axial hole (4*a*) formed therethrough; and a plurality of positioning bars (5) respectively extending through the positioning hole units (3) of the main frame (1) and the axial holes (4*a*) of the jingle units (4) so as to retain the jingle units (4) on the main frame (1).

The drawback of the above-described conventional tambourine is that the number of jingle slots (2) are fixed. Thus, the number of jingle units (4) on the main frame (1) cannot be changed.

Another drawback of the conventional tambourine is that the positioning bars (5) are fitted tightly within the positioning hole units (3) of the main frame (1). Hence, it is inconvenient to replace a damaged jingle unit (4) with a new one.

SUMMARY OF THE INVENTION

Therefore, the main object of this invention is to provide a tambourine in which the number of the jingle units that are mounted thereon can be varied.

Another object of this invention is to provide a tambourine that is constructed so that it is convenient to replace a damaged jingle unit of the tambourine with a new one.

According to this invention, a tambourine includes an annular frame, a plurality of jingle units, a plurality of positioning bars, and a plurality of flexible positioning plates. The annular frame has a plurality of equidistant rectangular positioning holes formed therethrough. Each of the positioning holes are defined by two longer hole walls and two shorter hole walls. The two longer hole walls have two stop ribs projecting toward each other therefrom. The flexible positioning plates are respectively fitted in the positioning holes of the annular frame. Each of the positioning plates has two longer side walls and two shorter side walls. Each of the longer side walls has a positioning rib projecting outward therefrom. The positioning ribs extend away from each other. Each of the shorter side walls has a locking rib projecting outward therefrom. The locking ribs extend away from each other. The positioning ribs of the longer side walls have an inward surface abutting against the outward surface of the corresponding longer hole wall. The locking ribs of the shorter side walls have an outward surface abutting against the inner surface of the annular frame so as to retain the positioning plate on the annular frame. Each of the positioning plates has at least one jingle slot which is formed therethrough and which extends in a direction parallel to the longer side walls. A pair of in-line receiving grooves are formed in the inward surface of the positioning plate on two sides of the slot and extend in a direction parallel to the two shorter side walls so that one of the positioning bars is received within the receiving grooves of the positioning plate. Each end of the positioning bar is positioned between one of the stop ribs of the annular frame and one of the positioning ribs of the two longer side walls of the positioning plate in such a manner that the jingle unit extends through the jingle slot of the positioning plate and is retained on the annular frame. When the annular frame is held and one of the flexible positioning plates is pressed outward, the positioning plate can be removed from the annular frame to replace a damaged jingle unit with a new one.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
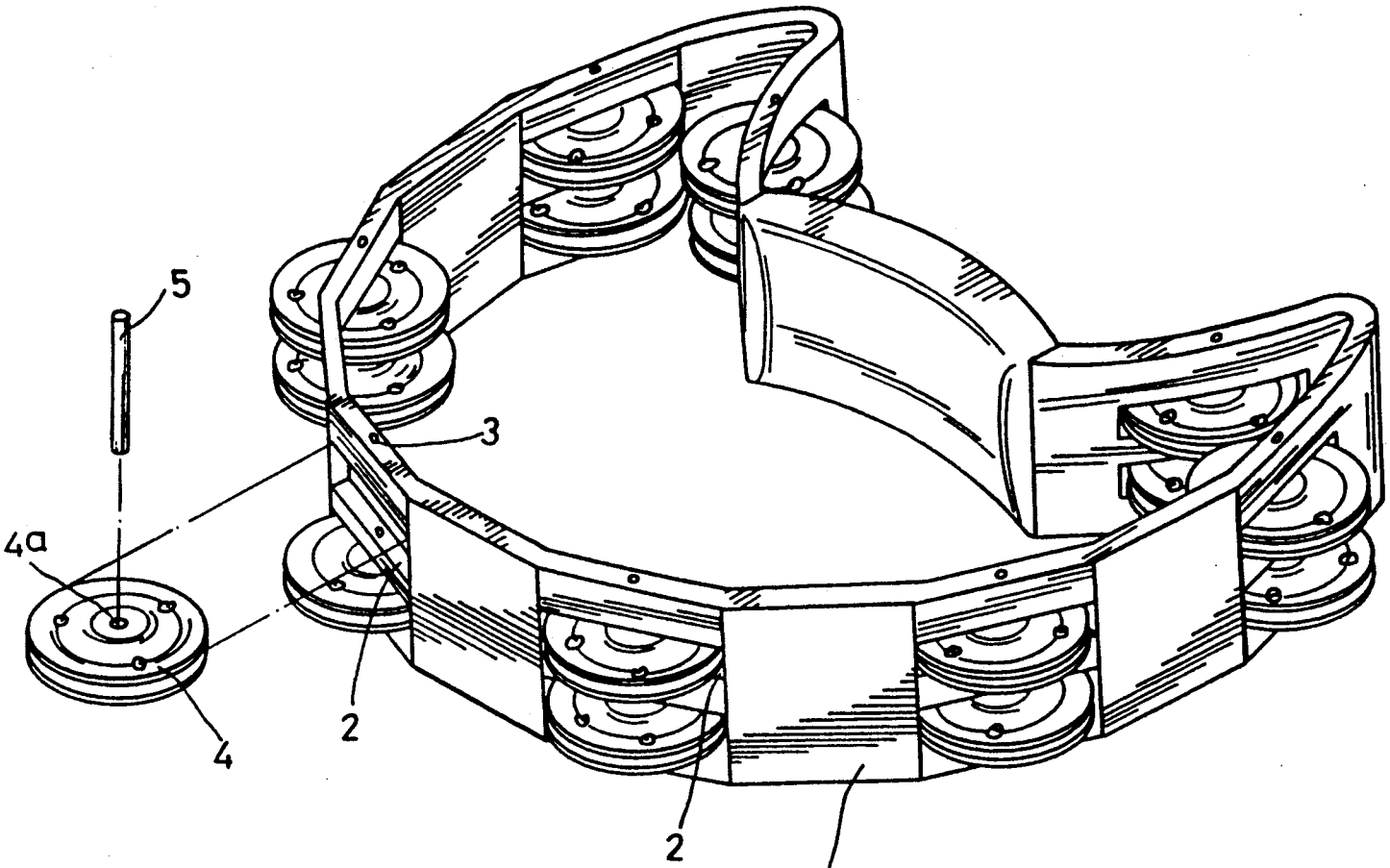
FIG. 1 PRIOR ART
FIG. 1 is a partly exploded perspective view showing a conventional tambourine.
Figure 2:
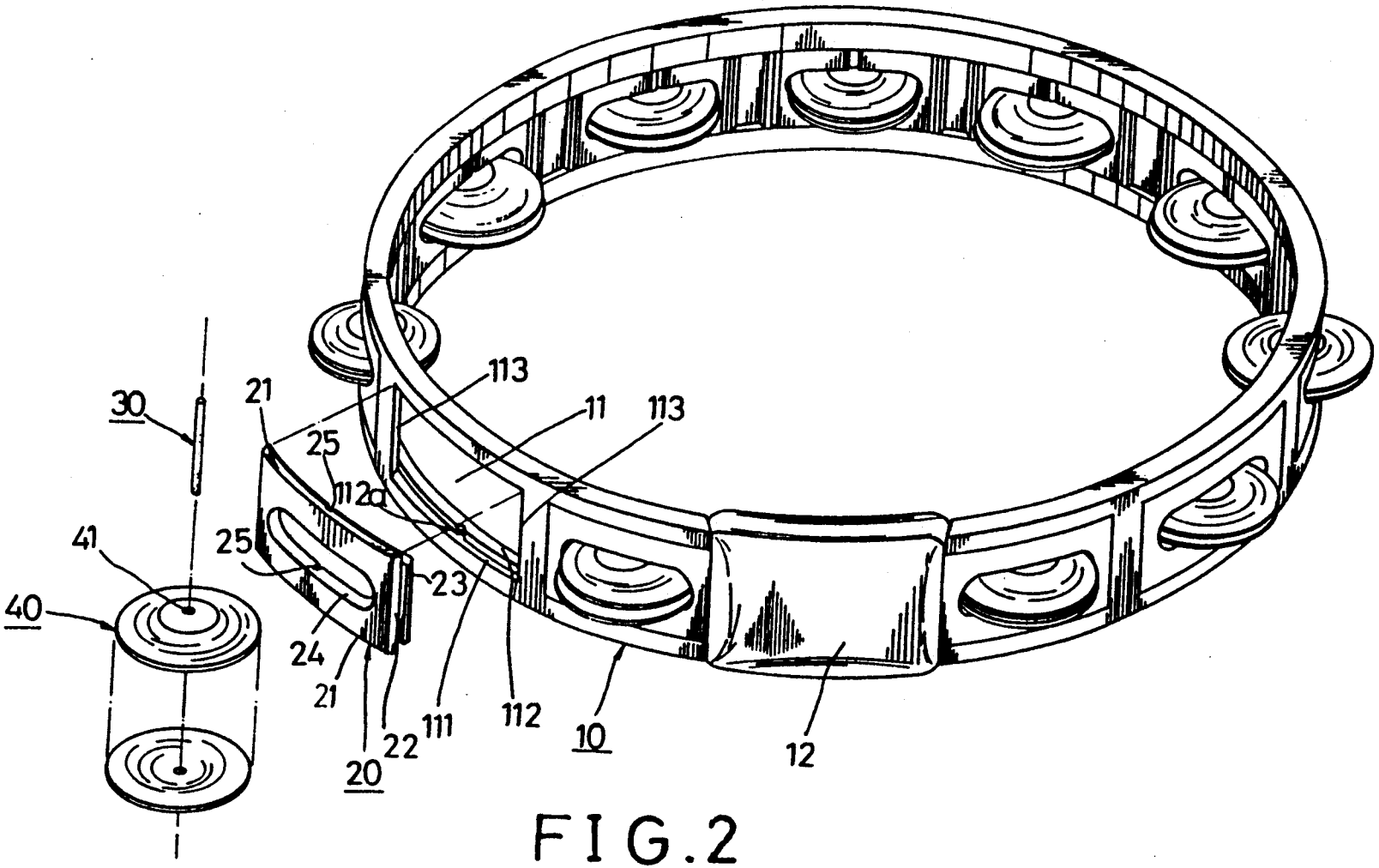
FIG. 2 is a partly exploded perspective view of a tambourine according to the first embodiment of this invention.
Figure 3:
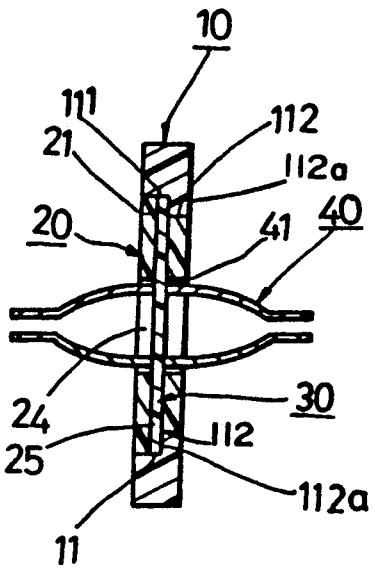
FIG. 3 is a cross section view of the tambourine according to the first embodiment of this invention.
Figure 4:
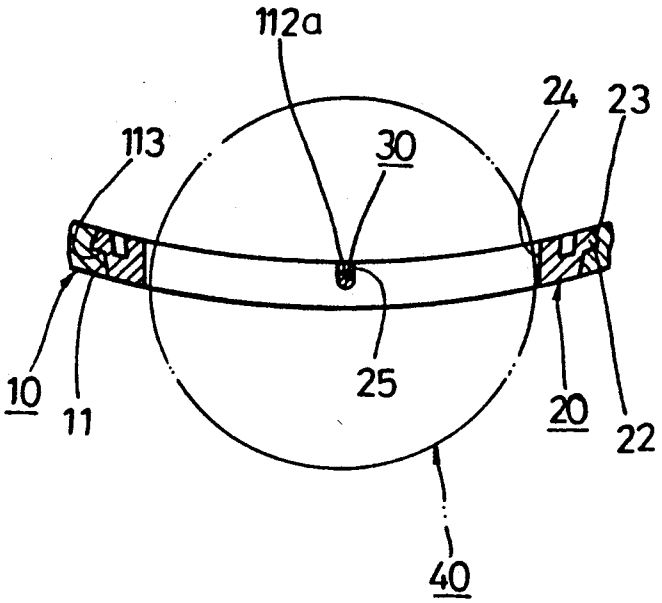
FIG. 4 is a fragmentary sectional view showing the tambourine according to the first embodiment of this invention.

Referring to FIGS. 2, 3 and 4, a tambourine according to this invention includes an annular frame (10), a plurality of flexible positioning plates (20), a plurality of positioning bars (30) and a plurality of jingle units (40). In this embodiment, the plates (20) are made of plastic.

The annular frame (10) has a plurality of equidistant rectangular positioning holes (11) provided therein, and a handle portion (12). Each of the positioning holes (11) is defined by two longer hole walls (111) and two shorter hole walls (113). There are two stop ribs (112), one on each of the two longer hole walls, which project toward each other. Each of the stop ribs (112) of the annular frame (10) has a positioning groove (112*a*) formed in a middle portion of the outward surface thereof.

The flexible positioning plates (20) may be different in color for aesthetic purposes and are respectively fitted in the positioning holes (11) of the annular frame (10). Each of the positioning plates (20) has two longer side walls and two shorter side walls. Each of the longer side walls has a positioning rib (21) projecting outward therefrom. The positioning ribs (21) extend away from each other. Each of the positioning ribs (21) of the longer side walls of the positioning plates (20) has an inward surface abutting against the outward surface of the corresponding stop rib (112) of the longer hole wall (111) of the annular frame (10). Each of the shorter side walls has a locking rib (22) projecting outward therefrom. The locking ribs (22) extend away from each other. Each of the locking ribs (22) of the shorter side walls of the positioning plates (20) has an outward surface abutting against the inner surface of the annular frame (10) so as to retain the positioning plate (20) on the annular frame (10). Each of the positioning plates (20) has at least one jingle slot (24) which is formed therethrough and which extends in a direction parallel to the longer side walls of the positioning plate (20), and a pair of in-line receiving grooves (25) which are formed in the inward surface of the positioning plate (25) on two sides of the slot (24) and which extends in a direction parallel to the two shorter side walls of the positioning plate (20). The positioning groove (112*a*) of the stop rib (112) of the annular frame (10) and the corresponding receiving groove (25) of the positioning plate (20) define a bar positioning space therebetween.

Each of the positioning bars (30) extends through the axial hole (41) of one jingle unit (40) and is received within the receiving groove (25) of the positioning plate (20). Each end of the positioning bar (30) is positioned in the corresponding bar positioning space in such a manner that the jingle unit (40) extends through the jingle slot (24) of the positioning plate (20) and is retained on the annular frame (10). Each of the locking ribs (22) has an inclined outer end surface (23) so as to define a tapered inner side portion of the positioning plate (20) in order to insert easily the positioning plate (20) into the corresponding positioning hole (11) of the annular frame (10). Furthermore, each of the positioning plates (20) has a tapered outer side portion so that the positioning plate (20) can be easily removed from the annular frame (10) by pressing the positioning plate (20) outward so as to replace a damaged jingle unit with a new one.

Figure 5:
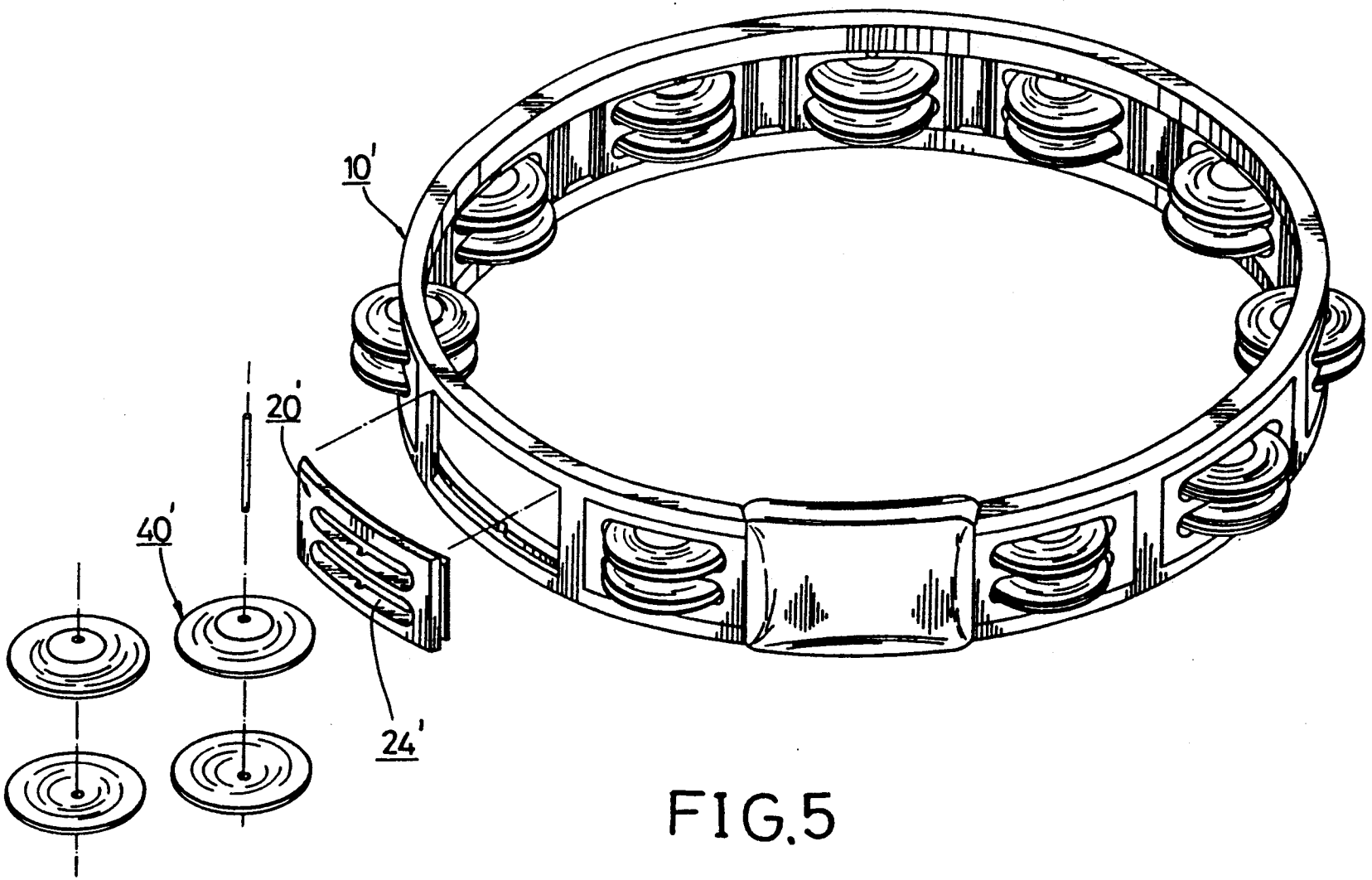
FIG. 5 is a partly exploded perspective view of the tambourine according to the second embodiment of this invention.
Figure 6:
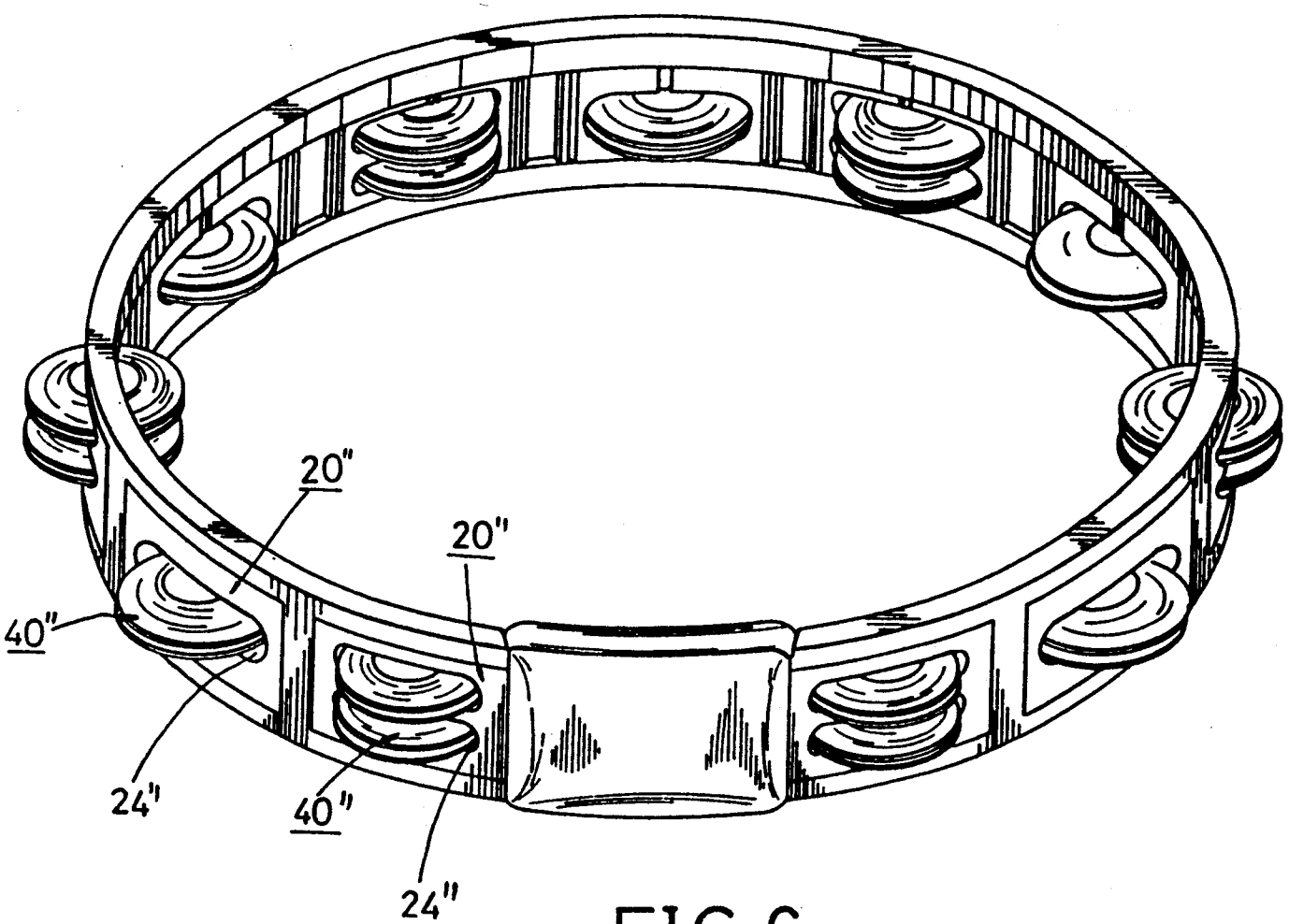
FIG. 6 is an assembled perspective view showing the tambourine according to the third embodiment of this invention.

Referring to FIG. 5, the second embodiment of this invention is shown. Unlike the first embodiment, each of the positioning plates (20') has two jingle slots (24') formed therethrough so that two jingle units (40') respectively extend through the two jingle slots (24') and are retained on the annular frame (10'). Referring to FIG. 6, the third embodiment of this invention is shown. Unlike the preceding embodiments, some of the positioning plates (20'') have one jingle slot (24'') through which one jingle unit (40'') extends, while the other positioning plates (20) have two jingle slots (24'') through which two jingle units (40'') respectively extend.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A tambourine comprising:

an annular frame having a plurality of jingle slots therein;

a plurality of jingle units, each of said jingle units extending through one of said jingle slots;

a plurality of positioning bars each extending through at least one of said jingle units and being coupled with said annular frame at two ends thereof so as to position each of said jingle units on said annular frame;

said annular frame having a plurality of equidistant rectangular positioning holes formed therethrough, each of said positioning holes being defined by two longer hole walls and two shorter hole walls, said two longer hole walls having two stop ribs each other which project respectively therefrom toward one another;

a plurality of flexible positioning plates respectively fitted in said positioning holes of said annular frame, each of said positioning plates having two longer side walls and two shorter side walls, each of said longer side walls having a positioning rib projecting outward therefrom, each said positioning rib extending away from one another, each of said shorter side walls having a locking rib projecting outward therefrom, each said locking rib extending away from one another, each said positioning rib of each said longer side wall having an inward surface abutting against an outward surface of a corresponding one of said stop ribs of said longer hole walls, each said locking rib of each said shorter side wall having an outward surface abutting against an inner surface of said annular frame so as to retain said positioning plate on said annular frame, each of said positioning plates having at least one said jingle slot formed therethrough and extending in a direction parallel to said longer side walls, and a pair of aligned receiving grooves formed in an inward surface of each said positioning plate along two sides of said slot and which grooves extend in a direction parallel to said two shorter side walls, each of said positioning bars being received within said receiving grooves of each of said positioning plates, each end of each of said positioning bars being positioned between one of said stop ribs of said annular frame and one of said positioning ribs of said two longer side walls of said positioning plate in such manner that each said jingle unit extends through each said jingle slot of each said positioning plate and is retained on said annular frame;

whereby, when said annular frame is held and one of said flexible positioning plates is pressed outward, said positioning plate can be removed from said annular frame to replace a damaged jingle unit with a new one.

2. A tambourine as claimed in claim 1, wherein each of said stop ribs of said annular frame has a groove formed in a middle portion of said outward surface of said stop rib so as to receive a corresponding end of said positioning bar to position said corresponding end of said positioning bar between said stop rib of said annular frame and said positioning rib of said positioning plate.

3. A tambourine as claimed in claim 1, wherein each of said locking ribs of said positioning plates has an inclined outer end surface to define a tapered inner side portion of said positioning plate, whereby said positioning plates can be inserted into said positioning holes of said annular frame.

4. A tambourine as claimed in claim 1, wherein each of said positioning plates has a tapered outer side portion, to facilitate removal of said positioning plates from said annular frame when said positioning plates are pressed outward.

* * * * *